US006681972B1

(12) United States Patent
Tapocik

(10) Patent No.: US 6,681,972 B1
(45) Date of Patent: Jan. 27, 2004

(54) HANDS-FREE HOLDER WHICH WILL HOLD AN AIRLINE TICKET, AN IDENTIFICATION, CREDIT CARDS AND CASH WHILE WORN AROUND A USER'S NECK

(75) Inventor: Claudette M. Tapocik, Riverside, CA (US)

(73) Assignee: J&C Tapocik, Inc., Riverside, CA (US)

( * ) Notice: Subject to any disclaimer, the term of this patent is extended or adjusted under 35 U.S.C. 154(b) by 16 days.

(21) Appl. No.: 10/102,273

(22) Filed: Mar. 19, 2002

(51) Int. Cl.[7] ..... A45C 11/18; A45C 1/06

(52) U.S. Cl. ..... 224/602; 224/236; 224/607; 224/610; 150/147

(58) Field of Search ..... 224/236, 602, 224/623, 191, 610, 607; 150/134, 147; 40/506; 383/106

(56) References Cited

U.S. PATENT DOCUMENTS

| | | | | | |
|---|---|---|---|---|---|
| D205,948 | S | * | 10/1966 | Tauber | D29/2 |
| 3,829,995 | A | * | 8/1974 | Fakoury | 40/16 |
| 3,999,317 | A | * | 12/1976 | Owens | 40/1.5 |
| 4,194,655 | A | * | 3/1980 | Tillotson | 224/191 |
| D261,077 | S | * | 10/1981 | Loomis | D3/52 |
| 4,492,390 | A | * | 1/1985 | Jacobs et al. | 281/31 |
| 4,570,688 | A | * | 2/1986 | Williams | 150/134 |
| 4,687,036 | A | * | 8/1987 | Thomas | 150/118 |
| 4,744,497 | A | * | 5/1988 | O'Neal | 224/202 |
| 4,890,728 | A | * | 1/1990 | Grimsley | 208/0.81 |
| 5,059,052 | A | * | 10/1991 | Casper | 402/80 R |
| 5,285,833 | A | * | 2/1994 | Haxby | 150/102 |
| 5,388,739 | A | * | 2/1995 | Gargan | 224/202 |
| D380,606 | S | * | 7/1997 | Chen | D3/226 |
| 5,678,620 | A | * | 10/1997 | Mayled | 150/134 |
| 5,784,816 | A | * | 7/1998 | Zapawa | 40/654.01 |
| 5,829,657 | A | * | 11/1998 | Romer, Jr. | 226/610 |
| 6,170,087 | B1 | * | 1/2001 | Brannon | 2/209.13 |
| D463,665 | S | * | 10/2002 | Sloot | D3/303 |

FOREIGN PATENT DOCUMENTS

| | | | |
|---|---|---|---|
| GB | 2284747 A | * | 6/1995 |
| JP | 2001-190329 A | * | 7/2001 |

OTHER PUBLICATIONS

United States Patent Application No. 2002/0179658 A1 to Talos–Hecker et al, Published Dec. 2002.*

United States Patent Application Publication No. 2001/0054245 A1 to Williams, Published Dec. 2001.*

United States Patent Application Publication No. 2002/0108284 A1 to Wallin, Published Aug. 2002.*

* cited by examiner

*Primary Examiner*—Sue A. Weaver
(74) *Attorney, Agent, or Firm*—Thomas I. Rozsa; Tony D. Chen

(57) ABSTRACT

The present invention is a holder for retaining documents which are necessary to board a means of public transportation, and which holder enables the documents to be retained in a manner wherein the documents can be easily verified by an examining agent and removed from the holder by the examining agent, while at the same time enabling the holder to be worn around a user's neck so that the user's hands are free to carry objects. The holder consists of a retaining body having a closed bottom and closed sidewalls and an open top so that an airline ticket can be retained in the open top so that it is readily accessible to be removed by the ticket agent at the time the passenger boards the airplane. The holder also has at least one plastic retaining means on one side so that the plastic retaining means is sealed against the holder on all of its edges except for one edge such as the top which is open so that a photo identification means such as a driver's license can be retained in the clear plastic sleeve so that the airline ticket agent can see the photo identification means to verify the passenger's identity before permitting the passenger to board the airplane. The holder also retains a strap so that the holder can be worn around the user's neck so that the user's hands are free to carry luggage or hold a child's hand or carry a baby.

39 Claims, 2 Drawing Sheets

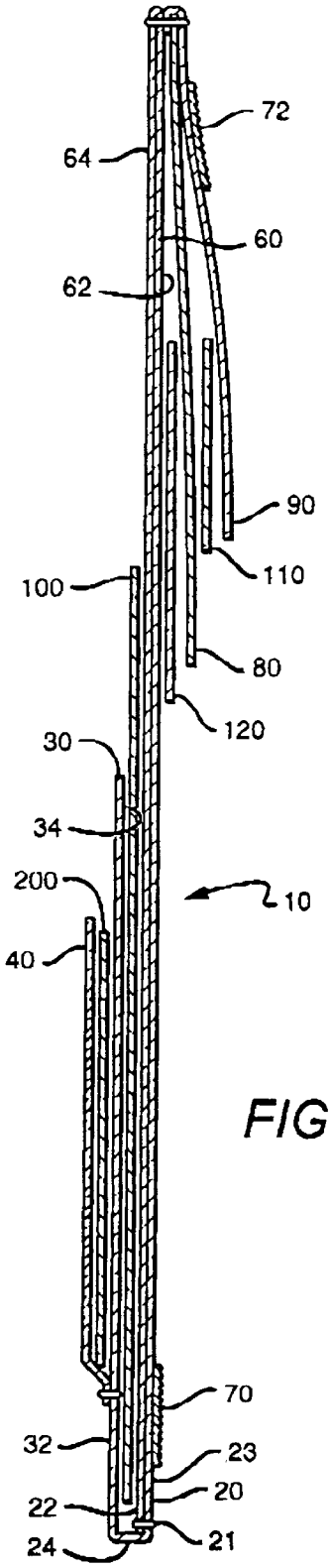
FIG. 4
FIG. 3
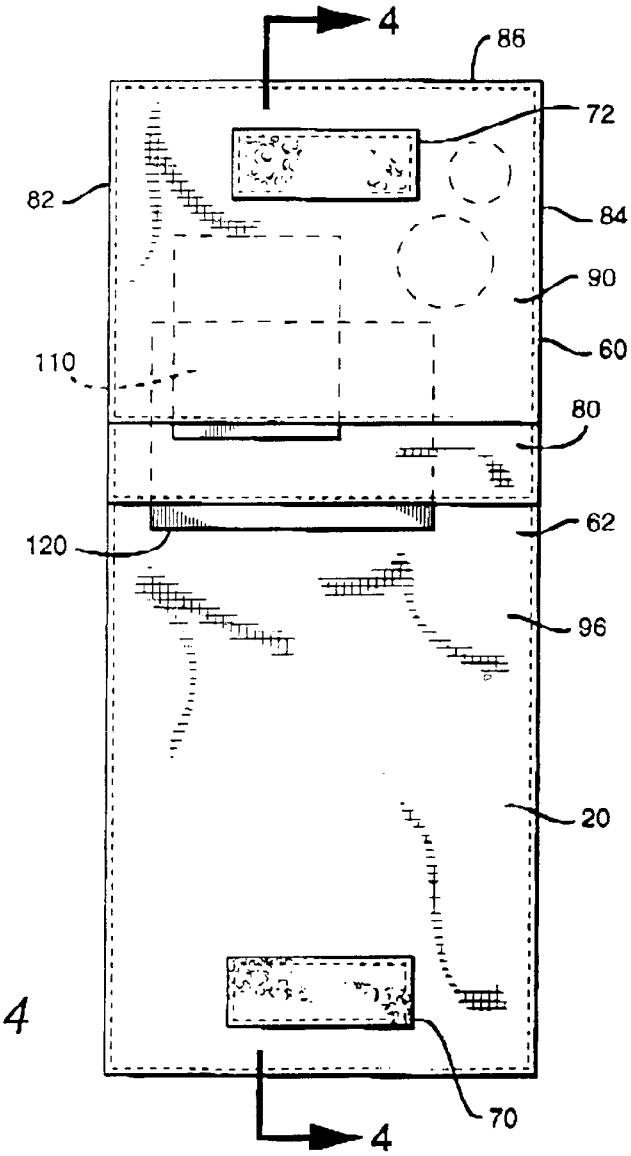

HANDS-FREE HOLDER WHICH WILL HOLD AN AIRLINE TICKET, AN IDENTIFICATION, CREDIT CARDS AND CASH WHILE WORN AROUND A USER'S NECK

BACKGROUND OF THE INVENTION

1. Field of the Invention

The present invention relates to the field of holders for carrying documents which are necessary for travel. The present invention also relates to the field of holders which can be used to carry any documents when boarding a means of public transportation such as an airplane.

2. Description of the Prior Art

In general, devices for carrying various articles and documents which enable the document holder to be worn around a user's neck have been known in the prior art. However, the inventions known in the prior art were created prior to the terrible tragedy of Sep. 11, 2001 when the two World Trade Center towers were destroyed. Subsequent to this tragedy, extra precautions have to be taken for screening and verifying passengers boarding a means of public transportation such as an airplane. The prior art patents did not focus on a holder to be used to carry any documents by passengers when boarding an airplane and instead, focused on a holder for carrying articles and documents for different purposes.

The following prior art references are found to be relevant in the general area of holders which can be used to carry documents and can be worn around a user's body parts such as a user's neck.

1. U.S. Pat. No. Des. 252,355 issued to Uber on Jul. 10; 1979 for "Gaming Pouch For Keno Or The Like" (hereafter the "Uber Patent");
2. U.S. Pat. No. 5,092,018 issued to Seron on Mar. 3, 1992 for "Lanyard Construction" (hereafter the "Seron Patent");
3. U.S. Pat. No. 5,178,311 issued to McBride on Jan. 12, 1993 for "Neck-Supported map Holder" (hereafter the "McBride Patent");
4. U.S. Pat. No. 5,388,739 issued to Gargan on Feb. 14, 1995 for "Commuter Ticket Holder" (hereafter the "Gargan Patent");
5. U.S. Pat. No. 5,784,816 issued to Zapawa on Jul. 28, 1998 for "ProtectiveTicket Holder And Memorabilia Device" (hereafter the "Zapawa Patent");
6. U.S. Pat. No. 5,829,657 issued to Romer on Nov. 3, 1998 for "Ticket Stub Display Device And Article Carrier Combination" (hereafter the "Romer Patent");
7. U.S. Pat. No. 5,862,526 issued to Longcor on Jan. 26, 1999 for "Expandable And Collapsible Belt-Strap Card Holder" (hereafter the "Longcor Patent");
8. European Patent Application No. EP 0 909 538 A3

The Uber Patent is a design patent which protects the shape or ornamental beauty of an object. It is a gaming pouch which basically discloses a pouch having a strap member and which has pockets therein for retaining money and other items associated with gaming.

The Seron Patent discloses an improved lanyard. It consists of two strap members 10 and 14 which come together in a mounting element 16 which itself contains a hook member which an be used to hold an identification card 18.

The McBride Patent essentially discloses a pouch for carrying a map so that it can be supported on a long string which is worn around a skier's neck. The map holder which has a ski area trail map or related printed information therein is visible by being in an exposed clear plastic holder which can be openable by means such as Velcro. The map holder includes a string or elastic to be positioned around the neck of the skier with the map supporting member attached to the string or elastic. The map or other information is exposed in the map supporting member. The string or elastic is sufficiently long so that the map can be read by the skier or a companion without the string or elastic being moved from around the neck of the skier.

The Gargan Patent discloses a clear plastic envelope which is designed to hold a commuter ticket and an opening through the top of the envelope through which an elastic neckband can be inserted so that a commuter ticket can be placed in the clear plastic envelope through an opening and the entire apparatus worn around the user's neck so that the user's hands are free and the ticket is clearly visible to anyone. In this device, the holder contains a clear plastic envelope in which the ticket is clearly visible and is supported by an elastic strap. It does not have any facility for holding anything else.

The Zapawa Patent is also a ticket holder which can be worn around a person's neck. Similar to the previously described patent, this ticket holder contains a generally rectangular transparent laminated memorabilia card, with the card including aligned rear and front panels with a common outer periphery. An insert displaying information is disposed between the rear panel and the front panel such that the insert is spaced away from the outer periphery and the rear panel is bonded to the front panel along the outer periphery. The ticket holder includes a transparent ticket pocket including aligned rear and front partitions in facing relation to one another and bonded the front panel of the card. An opening is provided in the ticket holder so that a cord 12 can be inserted through the opening so that the device can be worn around the user's neck.

The Romer Patent is designed specifically for carrying a portable radio or binoculars in addition to a ticket. The Romer Patent discloses a carrier having a body having front and rear walls, said walls being connected at side edges and bottom edges thereof, thereby defining a pouch having a closed bottom, closed sides and an openable top portion capable of receiving an article which in this case is defined as a portable scanning radio in the only independent claim. The device also has on its front an envelope structure coupled to said body so as to extend generally vertically from the body, said envelope structure having a front panel and a rear panel, certain edges of said front panel and said rear panel being joined together so as to define a pocket having an opening in which a generally planar item such as the ticket may be inserted, and may be visible through the pocket. There is also a suspending structure which in this case is a cord by which the entire apparatus can be worn around a user's neck. As can be seen from the pictures, the primary purpose of the central pocket is to hold an article such as a scanning radio, binoculars etc.

The Longcor Patent discloses an expandable and collapsible belt strap container for conveniently carrying sports cards on a person and comprises a container 10 having an inner side attached to the mid-portion 14 of a belt 12 by elastic webbings 13 and 13'. The container comprises an expandable and collapsible bellows 11 with an open top and a flap 18 hingeably attached to an outer side of the container. The flap stretches across the open top and down the inner side of the bellows. A long piece of hook-and-loop fastener 19 is attached to the inner side of the bellows while a short piece of hook-and-loop fastener 20 is attached to the distal side of the flap. Therefore, when the bellows is fully collapsed, the distal side of the flap may be attached to the lower side of the long fastener. When the bellows is fully expanded for carrying a large number of sports cards, the side of the flap may be attached to the upper side of the long fasteners.

The European Patent Application EP 0 909 538 A3 is very similar to the badge carrying device already discussed. It consists of a base section 4 that engages a cord 2 and an attachment section 6 that secures the object to be held or displayed. The cord 2 may be worn by a person such that the object, for example, an identification badge, key ring, etc. is held and/or displayed.

None of these prior art items focus on the principal object of the present invention which is to enable a user to carry in a hands-free manner a boarding ticket and personal verification means as well as other necessary means when boarding a means of public transportation such as an airplane.

SUMMARY OF THE INVENTION

The present invention is a holder for retaining documents which are necessary to board a means of public transportation and which holder enables the documents to be retained in a manner wherein the documents can be easily veirified by an examining agent and removed from the holder by the examining agent, while at the same time enabling the holder to be worn around a user's neck so that the user's hands are free to carry objects.

It has been discovered, according to the present invention, that if a holder is comprised of a retaining body having a closed bottom and closed sidewalls and an open top, an airline ticket can be retained in the open top so that it is readily accessible to be removed by the ticket agent at the time a passenger boards an airplane.

It has also been discovered, according to the present invention, that if the holder contains at least one plastic retaining means on one side so that the plastic retaining means is sealed against the holder on all of its edges except for one edge such as the top which is open, a photo identification means such as a driver's license can be retained in the clear plastic sleeve so that an airline ticket agent can see the photo identification means to verify the passenger's identity before permitting the passenger to board the airplane.

It has additionally been discovered, according to the present invention, that if the holder is designed in a foldable condition so that the holder can be folded and retained shut by closure means such as mating hook-and-loop fasteners of snap fasteners, then additional pockets can be manufactured into the interior wall of the holder means to retain additional items such as credit cards, passports, cash, and other personal items which the passenger may need either subsequent to boarding the airplane or prior to boarding the airplane.

It has further been discovered, according to the present invention, that if the holder has a strap or cord either permanently or removably affixed to the upper body of the foldable container, then the holder can be worn around the user's neck in a manner which permits the airline ticket to extend out of the opening in the container so that it can be examined by a ticket agent and the photo identification is visible through the clear plastic sleeve so that the airline ticket agent can verify the passenger's identity before permitting the passenger to board the airplane, while at the same time the user's hands are free to carry luggage, or carry a baby or hold a child's hand.

It is therefore an object of the present invention to create a document holder which can be worn around a user's neck so that the user's hands are free to carry luggage, hold a baby, or hold a child's hand, etc., while at the same time visibly retaining a boarding ticket in a manner which permits a ticket agent to remove the ticket for inspection without requiring the passenger to use his/her hands and assist the ticket agent and further provides a clearly visible photo identification which the airline ticket agent can clearly see without requiring the passenger to use his hands to assist the ticket agent, so that the ticket agent can verify the passenger's identity, all without requiring the passenger to release the items he or she is carrying.

It is another object of the present invention to provide a means to speed up the boarding of aircraft by providing a holder which enables a passenger to have the ticket and photo identification readily available for examination by the ticket agent. At present, there are substantial delays encountered when boarding an aircraft because the passenger has to place the passenger's luggage on the ground and reach into his/her pocket or purse to give the ticket agent the ticket and reach into his or her wallet to show the ticket agent the passenger's photo I.D. such as a driver's license. It is an object of the present invention to avoid these delays by having a holder in which the ticket is readily visible and retrievable by the ticket agent while at the same time displaying the photo identification without the necessity of the passenger having to remove these items from his possession and give them to the ticket agent, and thereby avoiding the delays in the boarding lines while other passengers are waiting to board the airplane.

It is a further object of the present invention to provide a hands-free holder to retain additional necessary items such as credit cards, cash, etc.

It is another object of the present invention to provide a hands-free holder for airline tickets, photo identification, user's credit cards and cash, which is of simple construction and light in weight so that it can be worn around the person's neck, even if the person is handicapped, in a manner which does not require any effort on the user's or passenger's part to display the ticket, photo identification or other items.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 3 is an elevational view of the hands-free holder in the open condition to expose the interior pockets.

FIG. 4 is a cross-sectional view taken along line 4—4 of FIG. 3.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 2:
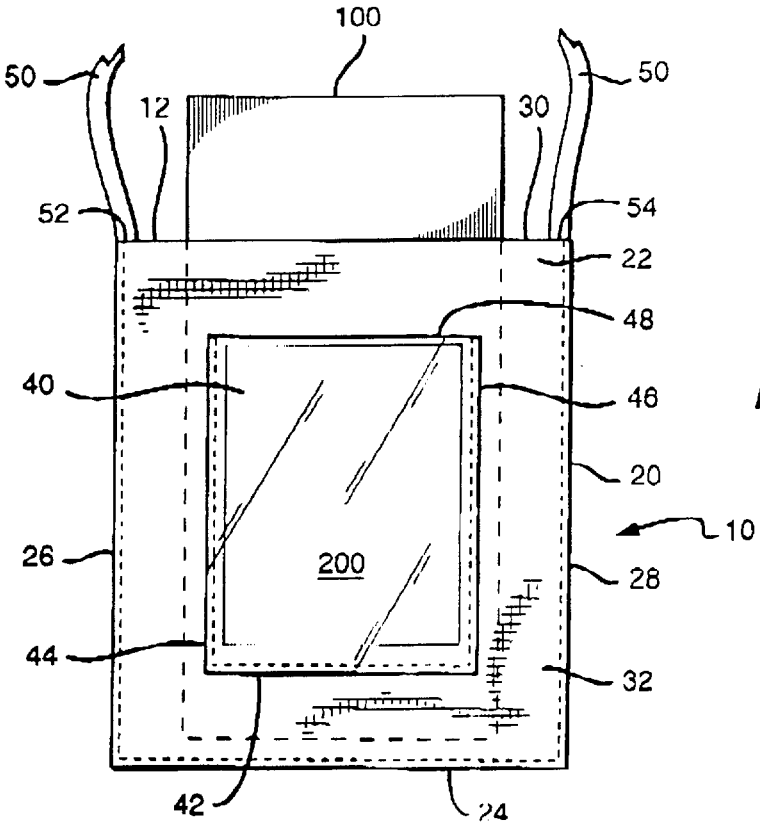
FIG. 2 is a front elevational view of the present invention hands-free holder with an airline ticket extending out of the top opening.

Referring to FIGS. 2, 3 and 4, the present invention hands-free holder is shown at 10 and comprises a foldable container having a first section 20 and a second section 60 which can be folded in half and retained closed by fastening means 70 and 72 which can by way of example be mating hook-and-loop fasteners or snap fasteners. Mating hook-and-loop fasteners are illustrated in FIG. 3.

First section 20 has an integrally formed first pocket 22 which extends for most of the length of first section 20 as illustrated in FIG. 2. The first pocket 22 is attached to the first section 20 along their adjacent bottom 24 and along their adjacent sidewalls 26 and 28, with the first pocket 22 being opened at its top edge 30 in order to receive a public transportation boarding document 100 which by way of example, is an airline ticket.

A clear retaining means 40 is attached to the front surface 32 of first pocket 22 so that the clear retaining means 40 is attached to the front surface 32 of first pocket 22 along its bottom edge 42 and along its sidewalls 44 and 46 so that its top edge 48 is open in order to receive and retain therein the photo identification means 200 which by way of example, can be a driver's license. It will be appreciated that the clear retaining means 40 can have any opening to receive the photo identification means along any of its walls but it is preferred that the top edge be the open edge in order to avoid having the photo identification means fall out of the clear retaining means 40.

A strap means 50 is attached to the top 12 of the hands-free holder 10 so that one end 52 of strap means 50 is attached adjacent first sidewall 26 and the second end 54 of the strap means 50 is attached adjacent second sidewall 28. The ends 52 and 54 can either be attached to the rear surface 34 of first pocket 22 which is the preferred embodiment or ends 52 and 54 can be attached to the front surface 21 of first section 20. The front surface 21 of first section 20 forms the rear wall of first pocket 22. In the preferred embodiment, ends 52 and 54 are permanently attached. It is also within the spirit and scope of the present invention to have ends 52 and 54 removably attached by fastening means such as mating hook-and-loop fasteners or snap fasteners.

Figure 1:
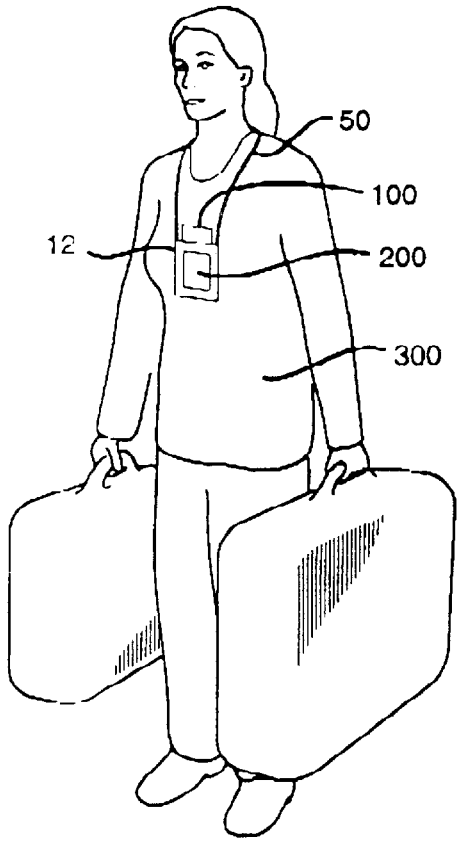
FIG. 1 is a perspective view of the present invention hands-free holder being worn around a passenger's neck while the passenger is carrying luggage with both hands.

With the hands-free holder in the folded condition as just described, the boarding document 100 extends out of the top edge 30 of the first pocket 22 so that it is clearly visible and can be removed by the ticket agent for processing before the passenger boards the means of public transportation. In addition, the photo identification 200 is clearly visible through clear retaining means 40 so that the ticket agent can verify the identity of the passenger at the same time. As illustrated in FIG. 1, the strap means 50 enables the passenger 300 to wear the hands-free holder around the passenger's neck with the boarding document 100 such as an airline ticket in the exposed condition and the photo identification 40 is clearly visible so that the passenger does not have to use the passenger's hands to expose the documents to the ticket agent and the passenger can use both hands to carry luggage as illustrated in FIG. 1 or for any other purpose such as to hold a baby, hold a child's hand, etc.

Referring to FIG. 3, the hands-free holder 10 is illustrated in the open condition. The second section 60 has a front surface 62 to which is attached at least one retaining means such as a pocket. In the illustration in FIG. 3, two pockets are illustrated therein, a first pocket 80 and a second pocket 90. First and second pockets 80 and 90 have common sidewalls 82 and 84 attached to the sidewall of second section 60 such that the first surface 62 forms the interior wall of each pocket. In the illustration in FIG. 4, the pockets 82 and 84 have a common bottom surface 86, but it is also within the spirit and scope of the present invention to have first pocket 80 be smaller than illustrated so that its lower surface extends further away from bottom 86. The pockets 82 and 84 can retain one or more credit cards 110, or cash 120, or any other objects necessary for the passenger.

The hands-free holder 10 is folded along its middle line 96 so that the fastener members 70 and 72 cause the pockets 80 and 82 to be concealed within the interior of the hands-free holder 10. In its folded condition, the hands-free holder appears as illustrated in FIG. 1.

In the preferred embodiment, the hands-free holder can be made of fabric material such as cotton. It will also be appreciated that the hands-free holder can be manufactured of any other material such as plastic.

While two pockets have been illustrated in FIG. 3, it will be appreciated that any number of interior pockets can be formed on the hands-free holder in either the first section or on the second section or on the same adjoining wall of the first section 20. In addition, pockets can be formed on the second surface 64 of second section 60. Also, while the pockets have been illustrated as generally flat pockets, they can also be accordion shaped so that more items can be retained therein.

Through use of the present invention, a passenger can have his or her hands free as illustrated in FIG. 1 with the primary items which are the boarding ticket 100 and the photo identification 200 clearly exposed so that a ticket agent can easily obtain access to both documents without the passenger having to remove the luggage from his hands and without the passenger having to delay in locating these objects at the time the passenger is boarding the means of public transportation such as an airline.

Defined in detail, the present invention is a hands-free holder for removably retaining a boarding document for a means of public transportation and for visibly retaining a photo identification document, the holder comprising. (a) foldable retaining body folded along its midline to form a first section and a second section; (b) the first section having an integrally formed first pocket which extends the length of the first section, the first pocket attached to the first section along their adjacent bottoms and along their adjacent first sidewall and second sidewall, with the first pocket being open at its top edge which is parallel to the top edge of the first section in order to receive the public transportation boarding document in a manner which permits the public transportation boarding document to be partially retained within the first pocket and partially extend out of the first pocket so that it can be easily removed by a ticket agent; (c) a clear retaining means attached to a front surface of the first pocket such that the clear retaining means is attached to the front surface along its bottom wall and sidewalls, the clear retaining means having an open top edge through which a photo identification means can be inserted and retained within the clear retaining means in a manner which permits the photo identification means to be clearly visible; (d) a strap means having two ends with one end attached adjacent the top edge of the first pocket and adjacent the first sidewall of the first section and the second end attached adjacent the top edge of the first pocket and adjacent the second sidewall of the first section so that the strap means forms a loop to enable the holder to be worn around the user's neck; (e) the second section having at least one pocket having an enclosed bottom wall and sidewalls attached to the second section and an open top through which an article may be inserted and retained in the at least one pocket such that the at least one pocket is concealed when the holder is in the folded condition; and (f) a first mating fastener located on an interior wall of the first section and a second mating fastener located on the second section to enable the holder to remain in the folded condition when the first and second mating fasteners are joined together.

Defined broadly, the present invention is a hands-free holder for removably retaining a boarding document for a means of public transportation and for visibly retaining a photo identification document, the holder comprising: (a) a foldable retaining body folded along its midline to form a first section and a second section; (b) the first section having an integrally formed first pocket which extends the length of the first section, the first pocket attached to the first section along their adjacent bottoms and along their adjacent first sidewall and second sidewall, with the first pocket being open at its top edge which is parallel to the top edge of the first section in order to receive the public transportation boarding document in a manner which permits the public transportation boarding document to be partially retained within the first pocket and partially extend out of the first pocket so that it can be easily removed by a ticket agent; (c) a clear retaining means attached to a front surface of the first pocket such that the clear retaining means is attached to the front surface along its bottom wall and sidewalls, the clear retaining means having an open top edge through which a photo identification means can be inserted and retained within the clear retaining means in a manner which permits the photo identification means to be clearly visible; (d) a strap means having two ends with one end: attached to the first section and adjacent the first sidewall of the first section and the second end attached to the first section and adjacent the second sidewall of the first section so that the strap means forms a loop; (e) the second section having at least one pocket having an enclosed bottom wall and sidewalls attached to the second section and an open top through which an article may be inserted and retained in the at least one pocket such that the at least one pocket is concealed when the holder is in the folded condition; and (f) a first mating fastener located on an interior wall of the first section and a second mating fastener located on the second section to enable the holder to remain in the folded condition when the first and second mating fasteners are joined together.

Defined more broadly, the present invention is a hands-free holder for removably retaining a boarding document for a means of public transportation and for visibly retaining a photo identification document, the holder comprising: (a) a foldable retaining body folded along its midline to form a first section and a second section; (b) the first section having an integrally formed first pocket, the first pocket attached to the first section along their adjacent bottoms and along their adjacent first sidewall and second sidewall, with the first pocket being open at its top edge which is parallel to the top edge of the first section in order to receive the public transportation boarding document in a manner which permits the public transportation boarding document to be partially retained within the first pocket and partially extend out of the first pocket so that it can be easily removed by a ticket agent; (c) a clear retaining means attached to a front surface of the first pocket such that the clear retaining means is attached to the front surface along all of its edges except for one open edge through which a photo identification means can be inserted and retained within the clear retaining means in a manner which permits the photo identification means to be clearly visible; (d) a strap means having two ends with each end attached to the first section so that the strap means forms a loop to enable the holder to be worn around the user's neck; (e) the second section having at least one pocket having an opening through which an article may be inserted and retained in the at least one pocket such that the at least one pocket is concealed when the holder is in the folded condition; and (f) a first mating fastener located on an interior wall of the first section and a second mating fastener located on the second section to enable the holder to remain in the folded condition when the first and second mating fasteners are joined together.

Defined even more broadly, the present invention is a hands-free holder for removably retaining a boarding document for a means of public transportation and for visibly retaining a photo identification document, the holder comprising: (a) a foldable retaining body folded along its midline to form a first section and a second section; (b) the first section having an integrally formed first pocket which is open at its top edge in order to receive a public transportation boarding document in a manner which permits the public transportation boarding document to be partially retained within the first pocket and partially extend out of the first pocket so that it can be easily removed by a ticket agent; (c) a clear retaining means attached to a front surface of the first pocket such that the clear retaining means is attached to the front surface such that it has at least one opening through which a photo identification means can be inserted and retained within the clear retaining means in a manner which permits the photo identification means to be clearly visible; (d) a strap means attached to the holder so that the strap means forms a loop to enable the holder to be worn around the user's neck; (e) the second section having at least one pocket having an opening through which an article may be inserted and retained in the at least one pocket such that the at least one pocket is concealed when the holder is in the folded condition; and (f) the holder having closure means to retain the holder in the folded condition.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A hands-free holder for removably retaining a boarding document for a means of public transportation and for visibly retaining a photo identification document, the holder comprising:

a. a foldable retaining body folded along its midline to form a first section and a second section;

b. said first section having an integrally formed first pocket which extends the length of the first section, the first pocket attached to the first section along their adjacent bottoms and along their adjacent first sidewall and second sidewall, with the first pocket being open at its top edge which is parallel to the top edge of said first section in order to receive the public transportation boarding document in a manner which permits the public transportation boarding document to be partially retained within the first pocket and partially extend out of the first pocket so that it can be easily removed by a ticket agent;

c. a clear retaining means attached to a front surface of said first pocket such that the clear retaining means is attached to the front surface along its bottom wall and sidewalls, the clear retaining means having an open top edge through which a photo identification means can be inserted and retained within the clear retaining means in a manner which permits the photo identification means to be clearly visible;

d. a strap means having two ends with one end attached adjacent the top edge of said first pocket and adjacent the first sidewall of the first section and the second end attached adjacent the top edge of said first pocket and adjacent the second sidewall of said first section so that the strap means forms a loop to enable the holder to be worn around the user's neck;

e. said second section having at least one pocket having an enclosed bottom wall and sidewalls attached to said second section and an open top through which an article may be inserted and retained in said at least one pocket such that said at least one pocket is concealed when said holder is in the folded condition; and f. a first mating fastener located on an interior wall of said first section and a second mating fastener located on said second section to enable said holder to remain in the folded condition when said first and second mating fasteners are joined together.

2. The hands-free holder as defined in claim 1, wherein said first section and said second section, said first pocket and said at least one pocket are made of fabric material.

3. The hands-free holder as defined in claim 2, wherein said fabric material is cotton.

4. The hands-free holder as defined in claim 2 wherein said fabric material is polyester.

5. The hands-free holder as defined in claim 2 wherein said fabric material is silk.

6. The hands-free holder as defined in claim 1, wherein said first section and said second section, said first pocket and said at least one pocket are made of vinyl material.

7. The hands-free holder as defined in claim 1, wherein said first section and said second section, said first pocket and said at least one pocket are made of leather material.

8. The hands-free holder as defined in claim 1, wherein the clear retaining means is made of plastic.

9. The hands-free holder as defined in claim 1, wherein said first and second mating means are hook-and-loop fasteners.

10. The hands-free holder as defined in claim 1, wherein said first and second mating means are snap fasteners.

11. The hands-free holder as defined in claim 1, wherein said boarding document is an airline ticket.

12. The hands-free holder as defined in claim 1, wherein said photo identification is a driver's license.

13. The hands-free holder as defined in claim 1, wherein said at least one pocket can retain cash, a credit card and a passport.

14. A hands-free holder for removably retaining a boarding document for a means of public transportation and for visibly retaining a photo identification document, the holder comprising:

a. a foldable retaining body folded along its midline to form a first section and a second section;

b. said first section having an integrally formed first pocket which extends the length of the first section, the first pocket attached to the first section along their adjacent bottoms and along their adjacent first sidewall and second sidewall, with the first pocket being open at its top edge which is parallel to the top edge of said first section in order to receive the public transportation boarding document in a manner which permits the public transportation boarding document to be partially retained within the first pocket and partially extend out of the first pocket so that it can be easily removed by a ticket agent;

c. a clear retaining means attached to a front surface of said first pocket such that the clear retaining means is attached to the front surface along its bottom wall and sidewalls, the clear retaining means having an open top edge through which a photo identification means can be inserted and retained within the clear retaining means in a manner which permits the photo identification means to be clearly visible;

d. a strap means having two ends with one end attached to said first section and adjacent the first sidewall of the first section and the second end attached to said first section and adjacent the second sidewall of said first section so that said strap means forms a loop;

e. said second section having at least one pocket having an enclosed bottom wall and sidewalls attached to said second section and an open top through which an article may be inserted and retained in said at least one pocket such that said at least one pocket is concealed when said holder is in the folded condition; and f. a first mating fastener located on an interior wall of said first section and a second mating fastener located on said second section to enable said holder to remain in the folded condition when said first and second mating fasteners are joined together.

15. The hands-free holder as defined in claim 14, wherein said first section and said second section, said first pocket and said at least one pocket are made of fabric material.

16. The hands-free holder as defined in claim 15, wherein said fabric material is cotton.

17. The hands-free holder as defined in claim 15, wherein said fabric material is polyester.

18. The hands-free holder as defined in claim 15, wherein said fabric material is silk.

19. The hands-free holder as defined in claim 14, wherein said first section and said second section, said first pocket and said at least one pocket are made of vinyl material.

20. The hands-free holder as defined in claim 14, wherein said first section and said second section, said first pocket and said at least one pocket are made of leather material.

21. The hands-free holder as defined in claim 14, wherein the clear retaining means is made of plastic.

22. The hands-free holder as defined in claim 14, wherein said first and second mating means are hook-and-loop fasteners.

23. The hands-free holder as defined in claim 14, wherein said first and second mating means are snap fasteners.

24. The hands-free holder as defined in claim 14, wherein said boarding document is an airline ticket.

25. The hands-free holder as defined in claim 14, wherein said photo identification is a driver's license.

26. The hands-free holder as defined in claim 14, wherein said at least one pocket can retain cash, a credit card and a passport.

27. A hands-free holder for removably retaining a boarding document for a means of public transportation and for visibly retaining a photo identification document, the holder comprising:

a. a foldable retaining body folded along its midline to form a first section and a second section;

b. said first section having an integrally formed first pocket, the first pocket attached to the first section along their adjacent bottoms and along their adjacent first sidewall and second sidewall, with the first pocket being open at its top edge which is parallel to the top edge of said first section in order to receive the public transportation boarding document in a manner which permits the public transportation boarding document to be partially retained within the first pocket and partially extend out of the first pocket so that it can be easily removed by a ticket agent;

c. a clear retaining means attached to a front surface of said first pocket such that the clear retaining means is attached to the front surface along all of its edges except for one open edge through which a photo identification means can be inserted and retained within the clear retaining means in a manner which permits the photo identification means to be clearly visible;

d. a strap means having two ends with each end attached to said first section so that the strap means forms a loop to enable the holder to be worn around the user's neck;

e. said second section having at least one pocket having an opening through which an article may be inserted and retained in said at least one pocket such that said at least one pocket is concealed when said holder is in the folded condition; and f. a first mating fastener located on an interior wall of said first section and a second mating fastener located on said second section to enable said holder to remain in the folded condition when said first and second mating fasteners are joined together.

28. The hands-free holder as defined in claim 27, wherein said first section and said second section, said first pocket and said at least one pocket are made of fabric material.

29. The hands-free holder as defined in claim 28, wherein said fabric material is cotton.

30. The hands-free holder as defined in claim 28, wherein said fabric material is polyester.

31. The hands-free holder as defined in claim 28, wherein said fabric material is silk.

32. The hands-free holder as defined in claim 27, wherein said first section and said second section, said first pocket and said at least one pocket are made of vinyl material.

33. The hands-free holder as defined in claim 27, wherein said first section and said second section, said first pocket and said at least one pocket are made of leather material.

34. The hands-free holder as defined in claim 27, wherein the clear retaining means is made of plastic.

35. The hands-free holder as defined in claim 27, wherein said first and second mating means are hook-and-loop fasteners.

36. The hands-free holder as defined in claim 27, wherein said first and second mating means are snap fasteners.

37. The hands-free holder as defined in claim 27, wherein said boarding document is an airline ticket.

38. The hands-free holder as defined in claim 27, wherein said photo identification is a driver's license.

39. The hands-free holder as defined in claim 27, wherein said at least one pocket can retain cash, a credit card and a passport.

* * * * *